US009537274B1

(12) United States Patent
Dankelmann et al.

(10) Patent No.: US 9,537,274 B1
(45) Date of Patent: Jan. 3, 2017

(54) MODULAR POWER AND CONNECTOR SYSTEM FOR LIGHTING ELEMENTS

(71) Applicant: Elemental LED, Inc., Emeryville, CA (US)

(72) Inventors: Andreas Dankelmann, Emeryville, CA (US); Russell Petersen, Alameda, CA (US)

(73) Assignee: Elemental LED, Inc., Emeryville, CA (US)

( * ) Notice: Subject to any disclaimer, the term of this patent is extended or adjusted under 35 U.S.C. 154(b) by 0 days.

(21) Appl. No.: 15/051,384

(22) Filed: Feb. 23, 2016

Related U.S. Application Data

(60) Provisional application No. 62/296,017, filed on Feb. 16, 2016.

(51) Int. Cl.

| | |
|---|---|
| ***H01R 12/00*** | (2006.01) |
| ***H01R 25/14*** | (2006.01) |
| ***H01R 13/62*** | (2006.01) |
| ***F21V 23/06*** | (2006.01) |
| ***A47F 3/00*** | (2006.01) |
| ***A47F 5/00*** | (2006.01) |

(52) U.S. Cl.
CPC ..... *H01R 25/142* (2013.01); *A47F 3/001* (2013.01); *A47F 5/0043* (2013.01); *F21S 4/28* (2016.01); *F21V 23/06* (2013.01); *H01R 13/6205* (2013.01)

(58) Field of Classification Search
CPC ..... F21S 4/28; F21S 8/02; F21S 8/024; H01R 25/142; A47F 3/001
USPC ..... 362/227, 238, 239
See application file for complete search history.

(56) References Cited

U.S. PATENT DOCUMENTS

| | | | |
|---|---|---|---|
| 4,973,796 | A | 11/1990 | Dougherty et al. |
| 5,695,261 | A | 12/1997 | Slesinger et al. |
| 6,231,205 | B1 | 5/2001 | Slesinger et al. |
| 6,780,034 | B2 | 8/2004 | Shiroshita et al. |
| 6,897,381 | B2 | 5/2005 | He et al. |
| 7,160,124 | B2 | 1/2007 | Bhutani |
| 7,549,784 | B1 | 6/2009 | Teeters |

(Continued)

OTHER PUBLICATIONS

Hera Lighting,"Electrified Shelf Systems: Power Standard." Internet. Available at http://www.heralighting.com/top/products/led/electrified-shelf-systems/power-standard/download-product-sheet/. No date.

(Continued)

*Primary Examiner* — Sean Gramling
*Assistant Examiner* — Gerald J Sufleta, II
(74) *Attorney, Agent, or Firm* — Patent Best; Andrew McAleavey

(57) ABSTRACT

A modular lighting system for use with shelving and a variety of other applications. A power track is adapted to be disposed within an upright support of a shelving unit. A power plug with vertically-aligned prongs inserts through existing openings in the upright support to reach conductors within the power track. The power plug has connecting structure to connect to a cable, and frangible portions that allow the cable to exit in a number of positions. Light bars carry the same connecting structures, can connect to the cable and snap together to extend continuously across a shelf. A second power track and second plug may provide power to the power track within the upright. The second plug carries the same connecting structure as the other components.

20 Claims, 11 Drawing Sheets

(56) References Cited

U.S. PATENT DOCUMENTS

| | | | | |
|---|---|---|---|---|
| 8,454,193 | B2 * | 6/2013 | Simon | F21K 9/175 362/217.17 |
| 8,545,045 | B2 | 10/2013 | Tress | |
| 8,864,347 | B2 | 10/2014 | Pearson et al. | |
| 8,939,779 | B1 | 1/2015 | Lindblom et al. | |
| 8,979,296 | B2 | 3/2015 | Wiemer et al. | |
| 9,057,513 | B2 | 6/2015 | Lindblom et al. | |
| 9,098,823 | B2 | 8/2015 | Slesinger et al. | |
| 9,115,858 | B2 | 8/2015 | Levante et al. | |
| 9,130,327 | B2 | 9/2015 | Flynn et al. | |
| 2006/0207778 | A1 * | 9/2006 | Walter | A47B 96/14 174/19 |
| 2006/0209537 | A1 | 9/2006 | Stelmasik et al. | |
| 2010/0097780 | A1 * | 4/2010 | Beatenbough | A47F 3/001 362/92 |
| 2011/0096533 | A1 * | 4/2011 | Sekela | A47F 3/001 362/125 |
| 2012/0182755 | A1 * | 7/2012 | Wildner | F21S 4/20 362/555 |
| 2013/0188356 | A1 * | 7/2013 | Breslow | A47F 3/001 362/247 |
| 2013/0299439 | A1 * | 11/2013 | Sid | A47F 5/0018 211/134 |
| 2014/0036505 | A1 | 2/2014 | Barton | |
| 2014/0292211 | A1 | 10/2014 | Huang | |
| 2014/0362574 | A1 | 12/2014 | Barrett | |
| 2015/0070882 | A1 | 3/2015 | Ohno | |
| 2016/0047539 | A1 * | 2/2016 | Cano | F21V 33/0012 362/133 |
| 2016/0048798 | A1 * | 2/2016 | Meyer | G06Q 10/087 705/28 |

OTHER PUBLICATIONS

Lozier, Quick Connect Lights, Feb. 24, 2016, 1-6, Omaha, NE.

* cited by examiner

MODULAR POWER AND CONNECTOR SYSTEM FOR LIGHTING ELEMENTS

BACKGROUND OF THE INVENTION

1. Field of the Invention

The invention relates to modular power and connector systems for lighting elements, and in particular to modular power and connector systems for light-emitting diode (LED) lighting elements.

2. Description of Related Art

In the last 15 years, light-emitting diodes (LEDs) have gone from an extravagant curiosity in the lighting industry to a viable and vital lighting source in any number of applications. LEDs require relatively little power, operate at low temperatures, have long life spans, are mechanically robust, and have a small footprint, especially when compared with traditional incandescent, and even fluorescent, light bulbs. All of those attributes make LEDs very advantageous to use in a variety of applications in which traditional lighting technologies would require too much space or generate too much heat, or when accessing and replacing traditional light bulbs would be too laborious or difficult. Additionally, the plethora of LED products on the market offer a variety of light levels (i.e., output lumens), colors, form factors, power supplies, and controls.

As a practical matter, the advantages of LEDs and the range of products that are available mean that an LED solution can be configured for virtually any lighting application. One of the more promising and commercially useful applications for LED lighting is in lighting shelving units, like gondola shelving units, where LED lighting can be used to illuminate products for sale.

U.S. Pat. No. 9,098,823 to Slesinger et al., which is incorporated by reference in its entirety, discloses a shelf power system. The Slesinger et al. patent illustrates both the ways in which LEDs and their power systems can be used in ingenious ways, and the ways in which they can be improved. In Slesinger et al., a power track is inserted into an upright support of a shelving unit. A power plug for a lighting fixture inserts through existing, regularly-spaced openings in the upright support to reach the power track. Yet this system has several shortcomings, including a plug made in both left-handed and right-handed configurations, and a shape and other characteristics that are unlikely to fit all, or even most, shelving units.

More broadly, while the characteristics of various LED lighting elements are becoming more standardized, the power sources, connectors, and other elements that power and connect to those lighting elements are far from standardized, and manufacturers continue to seek power, connection, and cabling systems that are modular, easy to install and check, and are adaptable enough to be suitable for a variety of applications.

SUMMARY OF THE INVENTION

One aspect of the invention relates to a power and lighting system adaptable to a number of applications, and particularly useful for lighting shelving units. Light bars—extrusions with lighting elements—terminate with inserts that carry common, complementary connecting structure, allowing the light bars to connect directly to one another to provide light over an entire span.

A first power track, typically a plastic extrusion, has conductors that run its length along a central portion. Two side portions are connected to the central portion resiliently, such that they can deflect slightly inwardly. The power track is adapted to be inserted into the upright support of a shelving unit. A complementary power plug has two vertically-offset prongs that are adapted to insert through existing openings in the upright support to reach the conductors of the power track. The ends of the prongs may be adapted so that their points of contact with the conductors are horizontally offset from one another. At least one of the prongs of the power plug is typically movable relative to the other prong in order to adapt to different spacings between openings in the upright support. The power plug also carries the same type of common, complementary connecting structure as the light bars, and includes a set of frangible portions that can be broken out to allow a cable to exit the power plug in any number of different positions.

A second power track is adapted to be external to the shelving unit, in order to provide power to several of the first power tracks, or to provide adaptability in where a single first power track is connected to power. The arrangement of the second power track may be different from that of the first power track, e.g., instead of being adjacent to one another on the central portion, the conductors of the second power track may be positioned on opposite sidewalls. However, a second power plug, intended for the second power track, carries the same complementary connecting structure as the other elements.

Other aspects, features, and advantages of the invention will be set forth in the description that follows.

BRIEF DESCRIPTION OF THE DRAWING FIGURES

The invention will be described with respect to the following drawing figures, in which like elements will be like reference numerals throughout the views, and in which.

DETAILED DESCRIPTION

Figure 1:
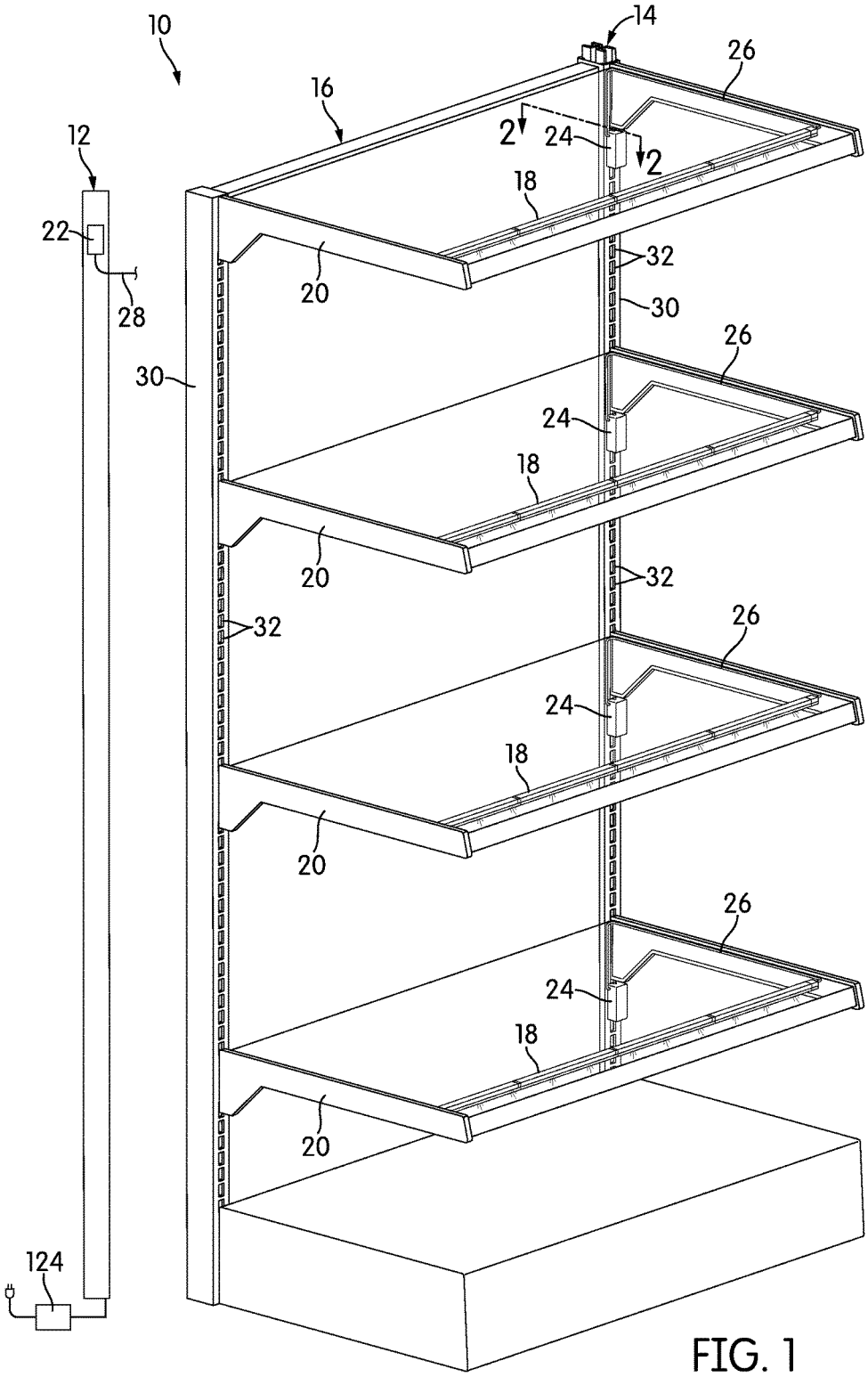
FIG. 1 is a perspective view of a system according to one embodiment of the invention.

FIG. 1 is a perspective view of a system, generally indicated at 10, according to one embodiment of the invention. As illustrated in FIG. 1, the system 10 comprises a number of modular parts, including a main power track 12, a power track 14 within an upright 30 of a shelving unit 16, modular light bars 18 disposed along each shelf 20 to light the shelving unit 16, connector plugs 22, 24 that connect to the respective power tracks 12, 14 and cables 26, 28 that connect between the components. As will be described below in more detail, the cables 26, 28, the light bars 18, and the connector plugs 22, 24 have common connecting structures, which improves their modularity and interchangeability.

While certain components are illustrated in FIG. 1, and there are definite advantages to using those components together, as those of skill in the art will note, it is not necessary that all of the components illustrated in FIG. 1 be used together in order to realize the advantages of embodiments of the invention. Moreover, while these components have particular advantages when used to power lighting elements for a shelving unit 16, they may be used in any number of other applications.

With a shelving unit like shelving unit 16, light bars 18 are typically placed so as to light each individual shelf 20, although that need not always be the case. The light bars 18 may be positioned along the forwardly-extending portion of the shelf 20, along the rear of the shelf 20, or at any other position, depending on the nature of the light bars 18 and the type of lighting effect that is desired. Depending on the application, the light bars 18 may use any type of adhesive or fastener to connect to the shelves 20. For these purposes, the fastener may be a mechanical fastener (screw, nail, etc.), a magnet, or anything else that can hold the light bars 18 to the shelf 20.

Because there are several individual shelves 20, there will typically be several sets of light bars 18 in any one installation of system 10, all of which require power. As the number of light bars 18 increases, so do the number of cables and the number of individual connections to power. One advantage of system 10 is that its elements provide a modular and scalable way to connect multiple elements to power, and do so in a way that is robust and is easy to install and check.

As shown in FIG. 1, the shelving unit 16 has a plurality of upright supports 30, usually at least two per shelf 20. As the shelving unit 16 is designed such that its shelves 20 can be placed at any number of distinct heights, each upright support 30 has a plurality of openings 32 at a regular pitch along its height, each opening 32 adapted to receive an engaging structure from a shelf 20.

Figure 2:
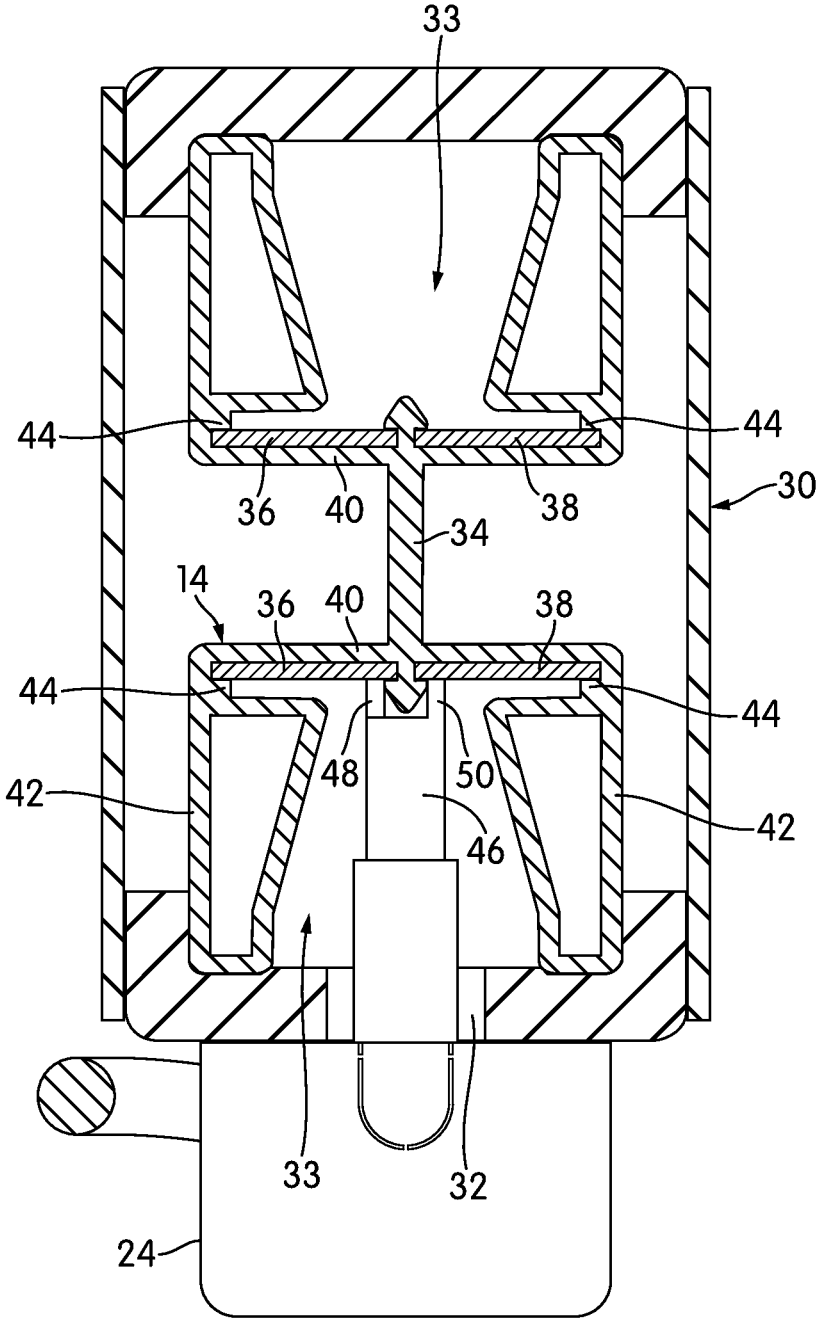
FIG. 2 is a cross-sectional view taken through Line 2-2 of FIG. 1, illustrating a power track within an upright support of a shelving unit.
Figure 3:
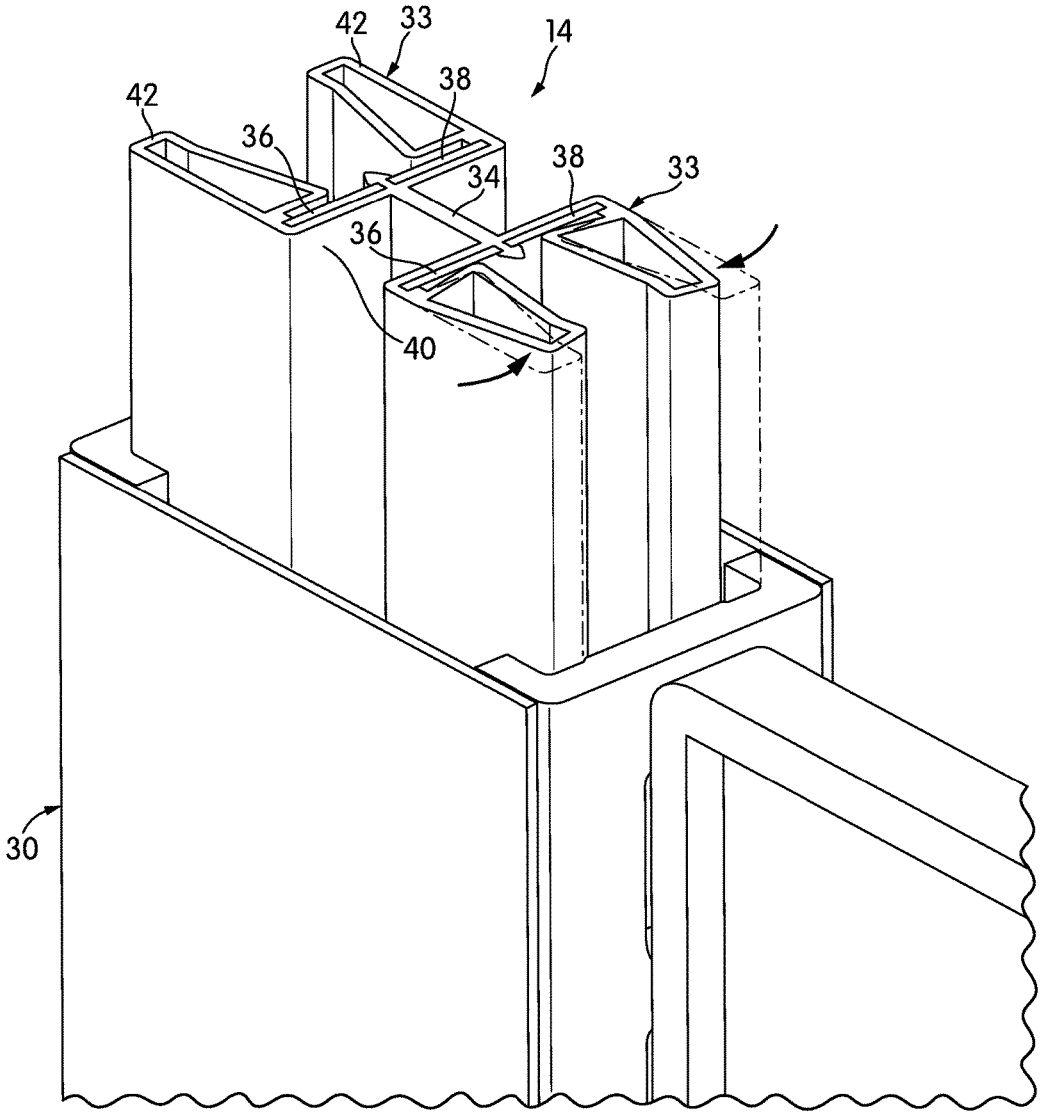
FIG. 3 is a perspective view of the power track of FIG. 2 being inserted into the upright of the shelving unit.

FIG. 2 is a cross-section taken through Line 2-2 of FIG. 1, and FIG. 3 is a perspective view of the end of one of the upright supports 30. As can be seen in the views of FIGS. 2 and 3, and as was noted briefly above, a double-sided power track 14 has been inserted into the interior space of the upright 30.

The double-sided power track 14 is made of a plastic or another nonconductive material and has two sides 33, opposite one another, each side 33 opening outward. The two sides 33 are connected by a central web or thickness of material 34. Each side 33 includes a power conductor strip 36 and a ground conductor strip 38 mounted on the flat, vertically-extending back 40 of the side 33. The power and ground conductor strips 36, 38 are typically bars or strips of metal. In some embodiments, the power conductor strip 36 and the ground conductor strip 38 may be contact traces formed lithographically on a metallization layer of a printed circuit board (PCB), such as an FR4 PCB.

Forwardly, each side 33 of the power track 14 is open to accept a connection, and the open sides face the openings 32 in the upright 30. While the shelving unit 16 is one-sided, many shelving units of this type are double-sided; the two sides 33 of the power track 14 allow the power track 14 to service both sides of a double-sided shelving unit 16. As will be described below in more detail, the power track 14 provides low voltage direct current (DC) power. However, in other embodiments, power tracks may provide low voltage alternating current (AC) power, or could operate using higher voltage DC or AC.

Connected to the back 40 of each side 33 of the power track 14 are a pair of side portions 42 that extend perpendicularly outward from the back 40. The side portions 42 are connected to the back 40 by way of a thin strip of material 44 that does not extend the full width of the side portions 42. Thus, the side portions 42 are permitted some degree of flexibility relative to the back 40, as can best be seen in the perspective view of FIG. 3. The side portions 42 may be biased or shaped to extend slightly to the sides (left and right), such that when inserted into the upright 30 and driven slightly inward, they will press outwardly on the walls of the upright 30 to create a tight, frictional fit and retain the power track 14 in place within the upright 30. The flexibility of the side portions 42 also allows the power track 14 to accommodate uprights 30 of slightly different sizes, such that a single power track 14 may be placed in a variety of shelving units 16 with differently-sized uprights 30.

As shown particularly in FIG. 2, in order to contact the respective conductors 36, 38, the prongs 46, 48 of the plug 24 extend through the existing openings 32 in the upright 30. This means that with the power track 14 disposed in the upright 30 and the plug 24 adapted to be inserted through the openings 32 in the upright to reach the power track 14, the light bars 18 can be plugged in anywhere along the upright 30, which allows the placement of the light bars 18 to be as flexible and adaptable as the placement of the shelves 20 themselves.

Figure 4:
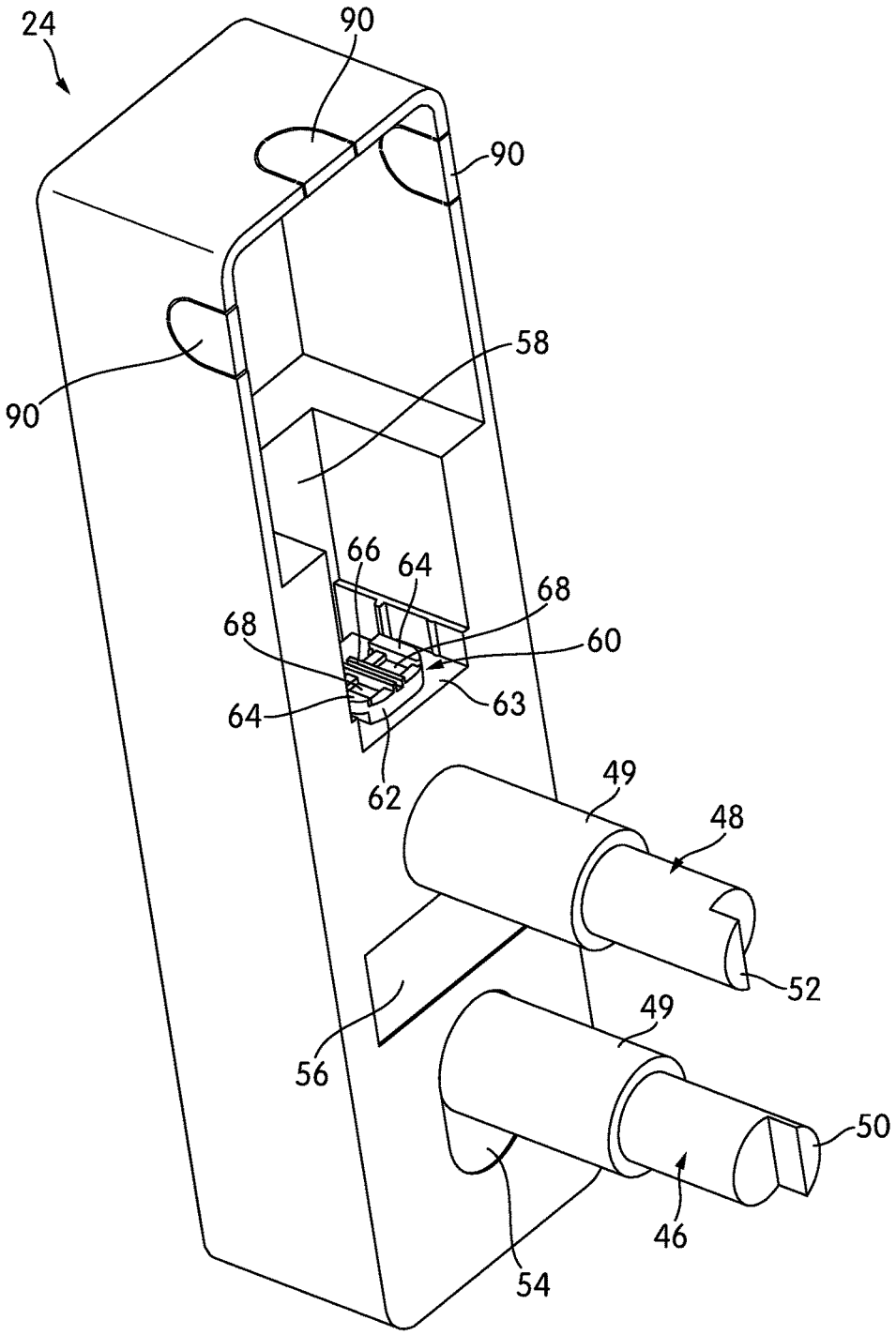
FIG. 4 is a perspective view of a shelf power connector.

FIG. 4 is a perspective view of the connector plug 24 in isolation. As shown, the prongs 46, 48 of the plug 24 are relatively long. Each prong 46, 48 has a contact tip 50, 52 that covers only a portion of the end-face surface area of the prong 46, 48. Moreover, the tip 50 of one prong 46 extends only on one side of the prong 46, while the tip 52 of the other prong 48 extends only on the opposite side of its prong 48.

In order to be inserted through the openings 32, the prongs 46, 48 must be reasonably well aligned with one another vertically. However, as is shown in the view of FIG. 2, the two conductors 36, 38 are horizontally spaced from one another. The opposite-sided tips 50, 52 allow each prong 46, 48 to be in electrical contact with only one of the two conductors 36, 38 so as to avoid a short circuit. Additionally, proximal portions 49 of the prongs 46, 48 are typically surrounded by a housing 49, for example, a hard plastic, to prevent a short as the prongs 46, 48 transit the openings 32. The prongs 46, 48 may be movable and spring-biased within the housing 49, such that they have some ability to translate in and out and to remain in contact with the conductors 36, 38.

The connector plug 24 also includes other adaptations and features that allow it to be used as shown in FIGS. 1 and 2. For example, the spacing between the openings 32 in an upright 30 is typically reasonably consistent for a single upright. That is, within a specified manufacturing tolerance, the pitch or spacing between the openings 32 is typically the same. However, different shelving units 16 may have uprights with different spacings between their openings. For that reason, the connector plug 24 has a feature that allows it to adapt to differences in spacing. Specifically, one prong 46 of the connector plug 24 is movable within a defined range of motion to provide more adaptability. Essentially, the prong 46 rides within a slot 54. Depending on the embodiment, the prong 46 may be biased by a resilient member, such as a spring, to return to a particular position, or it may slide freely within the slot 54.

The connector plug 24 also preferably has features to aid in its securement. Traditional household and commercial plugs that are designed to insert into single outlets often use the frictional interaction between the plug and outlet to stay in place. Plugs designed for tracks often use twist lock and other types of mechanisms to stay in place. However, the connector plug 24 is in a unique situation: it is plugging into a track 14 through an opening 32 that acts as an outlet but was never designed to receive a plug 24. Thus, additional securement features are advantageous. In the case of the plug 24, since most uprights 30 are made of ferromagnetic steel, a magnet 56 is provided between the prongs 46, 48 on the upright-facing side of the plug 24. In other embodiments, the securement feature could be an adhesive pad, hook and loop fastener, or any other material or device that will attach the plug 24 more securely to the upright 30.

As will be appreciated from FIG. 4, the plug 24 is not hardwired to a cable or power cord 26. Approximately the lower half of the plug 24 is open. Inside a rectangular cavity or socket 58, the plug 24 includes male connecting structure 60. The male connecting structure 60 is designed such that a complementary female connecting structure can be slipped directly over it by pressing directly into the cavity or socket 58.

The male connecting structure 60 is elevated relative to the sidewall 63 of the cavity 58 to which it is attached, and includes a tapered or rounded leading edge 62 that broadens and widens out to two side flanges 64 that project out to the sides with empty space between them and the sidewall 63 of the cavity. The male connecting structure 60 also includes a central channel 66 and two recessed, conductive electrical contacts 68.

Figure 5:
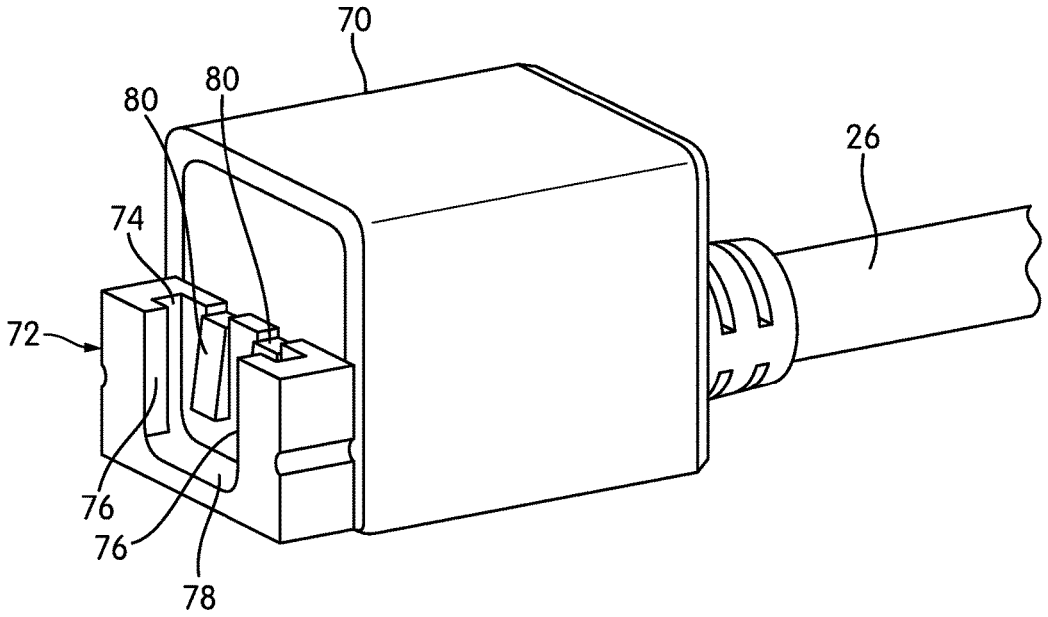
FIG. 5 is a perspective view of the complementary connecting structure on a cable.

As shown in the perspective view of FIG. 5, the connector 70 of a cable 26 carries the complementary female connecting structure 72. An open socket 74 has inwardly-extending flanges 76 that are complementary to, and intended to engage, the side flanges 64 of the male connecting structure 60. The floor 78 of the open socket 74 is curved to match the curvature of the leading edge 62 of the male connecting structure 60. Within the open socket 74 are two conductive contacts 80, which may be resilient, or resiliently biased, to extend outwardly, such that they engage the recessed contacts 68 of the male connecting structure 60.

Once the cable 26 and the plug 24 are connected, the plug 24 has features that allow the cable 26 to exit the plug 24 in a number of ways, so as to facilitate modularity and flexible installation. Specifically, as can be seen in the perspective view of FIG. 4, the lower portion of the plug 24 has three elongated semicircular frangible portions 90 that can be selectively broken-out to provide space for the cable 26 to transit into and out of the plug 24. In the illustrated embodiment, the frangible portions 90 are arranged one-per-face on three sides of the plug 24. However, the number and placement of frangible portions 90 may vary from embodiment to embodiment.

Figure 6:
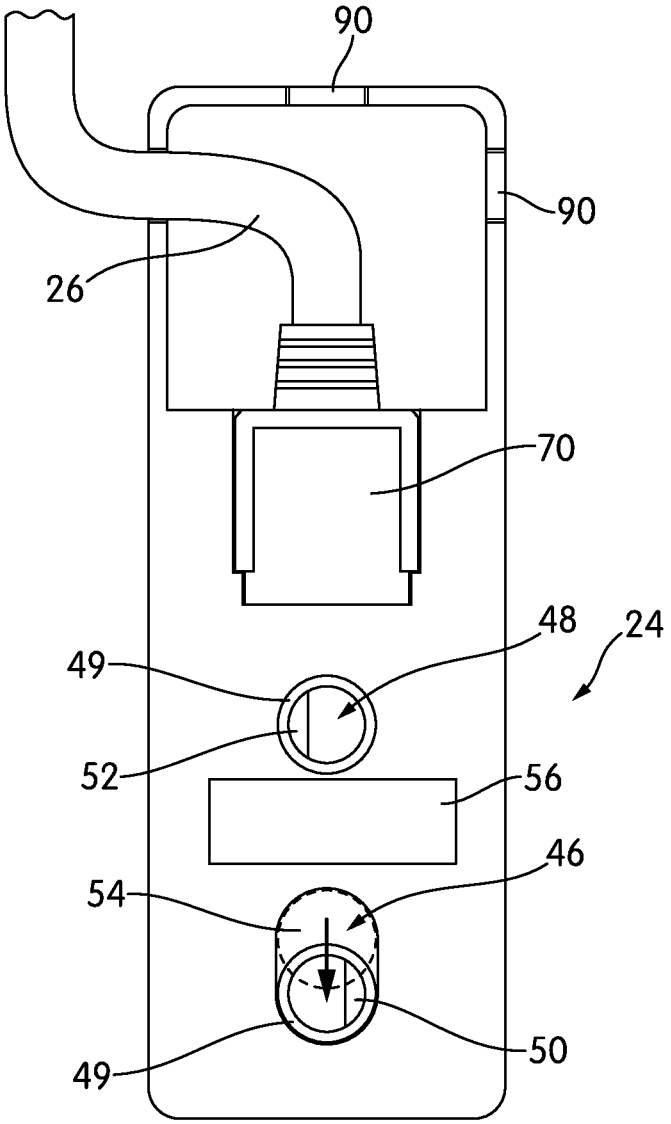
FIG. 6 is an elevational view of the shelf power connector of FIG. 4.

FIG. 6 is an elevational view of the plug 24 with the cable 26 installed. As shown, the connector 70 is installed within the socket 58, and one of the three frangible portions 90 has been broken out to allow the cable 26 to exit through a side of the plug 24. FIG. 6 also illustrates the range of travel of the contact prong 46 within its slot 54.

The other end of the cable 26 also has a connector 70, and as shown in FIG. 1, connects to and powers a light bar 18. Fundamentally, the light bar 18 is an extrusion, or another type of enclosure, with lighting elements inside. In most embodiments, the lighting elements will be LED lighting elements—such as LED tape. (For a description of LED tape, see U.S. Pat. No. 9,239,136 to Petersen et al., the contents of which are incorporated by reference in their entirety.) However, as those of skill in the art will recognize, the lighting elements may be any sort of lighting elements capable of operating at low voltages.

Various types of extrusions are well known in the art, and any extrusion suitable for the particular installation may be used. Extrusions may be metal (e.g., aluminum), plastic, or any other suitable material. U.S. patent application Ser. No. 14/184,475, filed Feb. 19, 2014, and U.S. patent application Ser. No. 14/707,962, filed May 8, 2015, disclose various types and profiles of extrusions, as well as extrusion features that may be helpful in laying down or installing the lighting elements, and both of those applications are incorporated by reference in their entireties.

Figure 7:
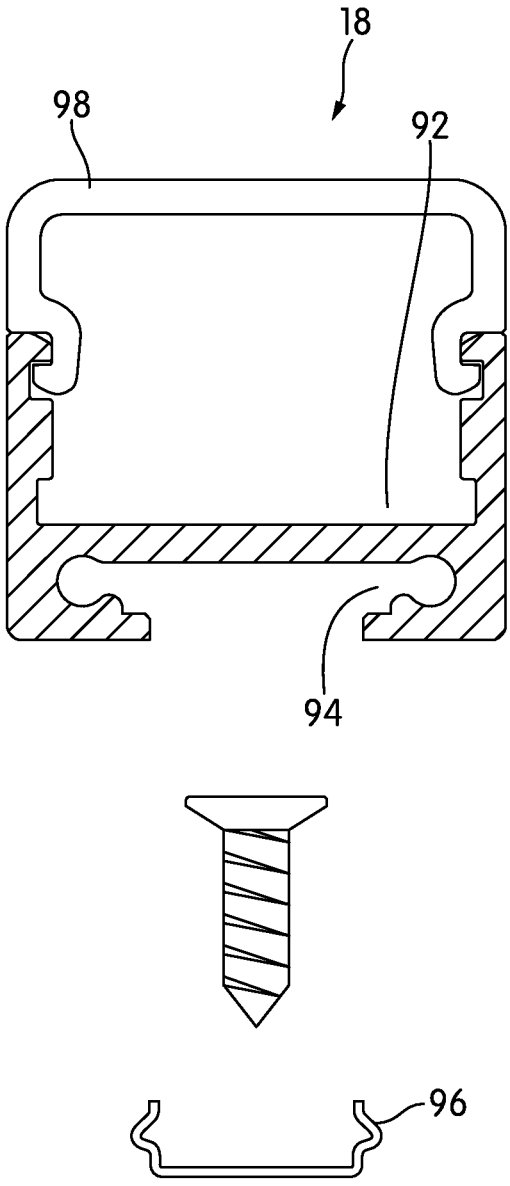
FIG. 7 is a cross-sectional view of a light bar of FIG. 1.

FIG. 7 is an exploded cross-section of a light bar 18, illustrating one possible arrangement. The light bar 18 has a main channel 92, into which lighting elements are placed, and a mounting channel 94, which is used to mount the light bar 18 to a shelf 20 or to another surface. In some cases, the main channel 92 may include grooves or locating features, as disclosed in U.S. application Ser. No. 14/707,962, which is incorporated by reference in its entirety. The mounting channel 92 may have whatever features are necessary to mount it in the application for which it is intended. In the illustrated embodiment, a spring clip 96 is pressed into the mounting channel 92. The spring clip 96 has appropriate openings for screws. Alternatively, the light bar 18 may be mounted with an appropriate adhesive, in which case, it may be flat-backed or have a mounting channel 92 that merely has a small recess, so that the adhesive or tape is flush with the rear surface. Instead of adhesives, other fasteners, including magnets, may be used. The light bar 18 also has a diffuser 98 covering the main channel 92. The diffuser 98 is typically made of a translucent plastic, but is typically not fully transparent—frosting or a pattern is typically provided to obscure the view of the lighting elements.

Figure 8:
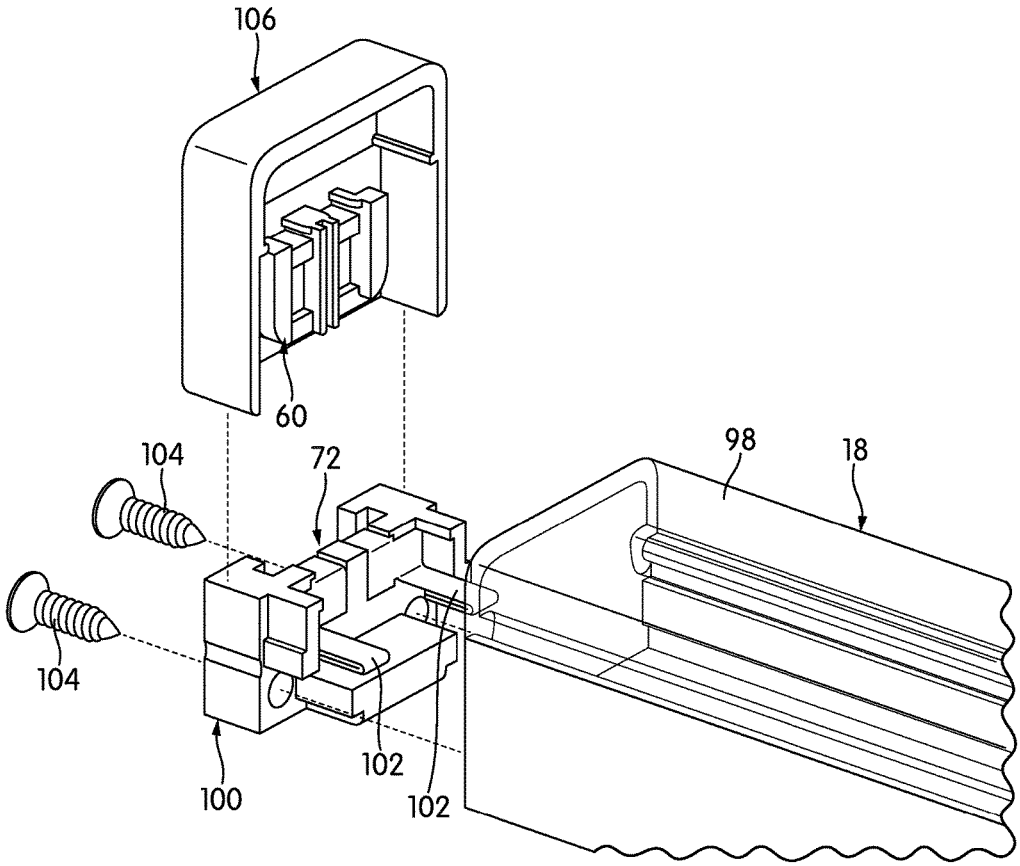
FIG. 8 is an exploded perspective view illustrating the end termination of a light bar in the system of FIG. 1.

In order to function with the rest of system 10, ends of the light bars 18 are provided with fittings that carry the same modular connecting structure 60, 72 as is used between the plug 24 and the cable 26. FIG. 8 is a perspective view illustrating this structure. As shown in FIG. 8, an insert 100 is placed into the end of the first channel 92, typically secured with screws 104. The insert 100 has contacts 102 that connect electrically with the electrical contacts of the lighting elements in the channel 92 and, on its other side, carries female connecting structure 72. If the light bar 18 is the last in a series, the insert 100 may be electrically terminated, as shown in FIG. 8, by a cap 106 that carries the male connecting structure 60 along an interior face. The cap 106 itself is typically made of a plastic, or another insulating material.

Figure 9:
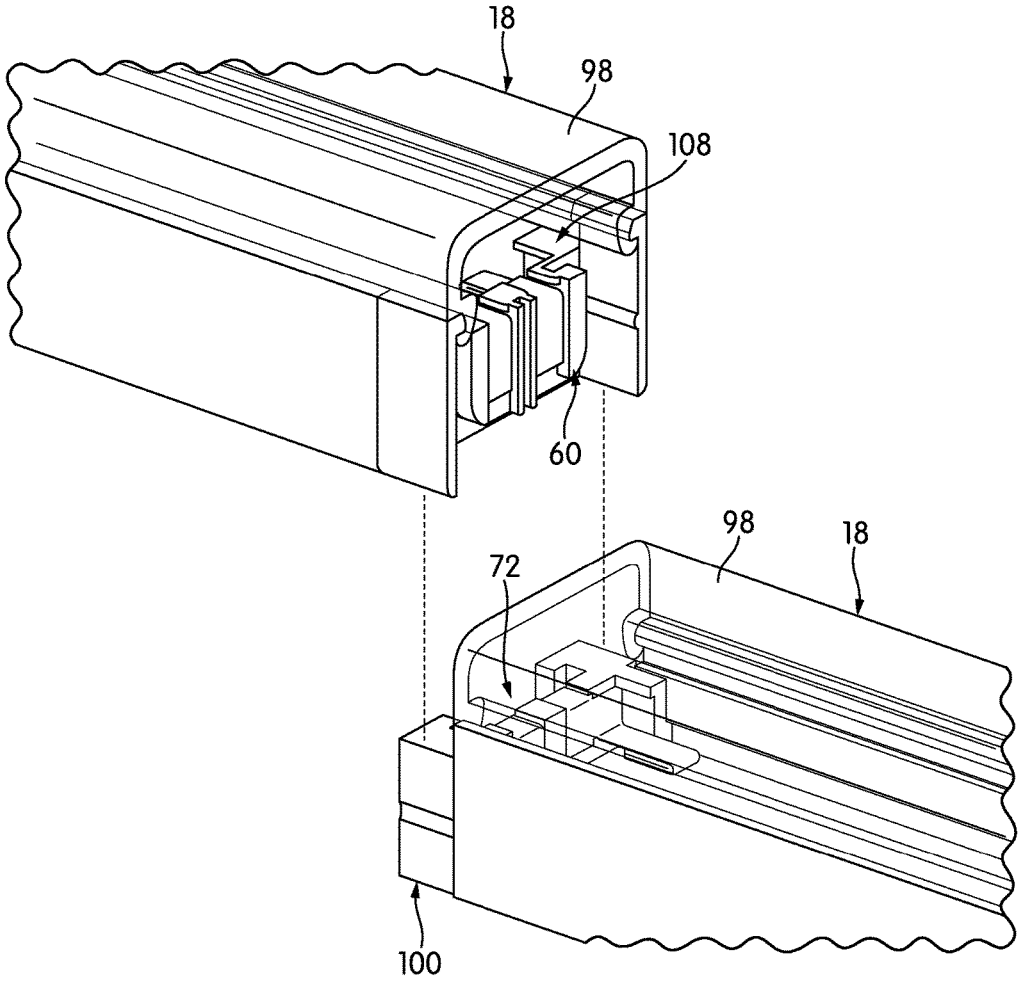
FIG. 9 is an exploded perspective view illustrating the connection of two modular light bars at their ends.

If two light bars 18 are to be connected in series, as shown in the perspective view of FIG. 9, the end of one light bar 18 may be provided with the insert 100 that carries female connecting structure 72, while the other light bar may be provided with a similar insert 108 that carries male connecting structure 60. Thus, the ends of the two light bars 18 can simply slide into one another to make a positive electrical connection, so as to connect two or more light bars 18 in series without adjoining cables, essentially maintaining the same profile and form factor over a long length. The light bars 18 and the inserts 100, 108 can be dimensioned such that there is little visual interruption in the light when transitioning from one light bar 18 to the next.

The number of light bars 18 connected in series is not limited, so long as sufficient power is available to power all of them. If necessary, more than one power source may be connected to power multiple light bars 18.

As those of skill in the art will appreciate, while certain components are shown as having "male" connectors and others are shown as having "female" connectors, the sense may be reversed in some installations. Additionally, the terms "male" and "female" are used to distinguish the two complementary types of connectors from one another for descriptive purposes; they do not necessarily imply a particular structure or kind of structure.

At their ends, the power tracks 14 within the uprights 30 would typically use inserts similar to the inserts 100, 108 to terminate—i.e., the inserts would carry the same common connecting structure 60, 72 as is used on the other components. In some embodiments, a power track 14 within an upright 30 may be connected directly to a transformer and its own power supply (i.e., AC household or commercial power).

However, as shown in FIG. 1 and described briefly above, a main power track 12 may be used to provide power to several power tracks 14 or other components. A cable 28 connects each power track 14 to its power source. The cable 28 may be the same as the cable 26, or it may be different (e.g., smaller or larger), depending on the embodiment.

Figure 10:
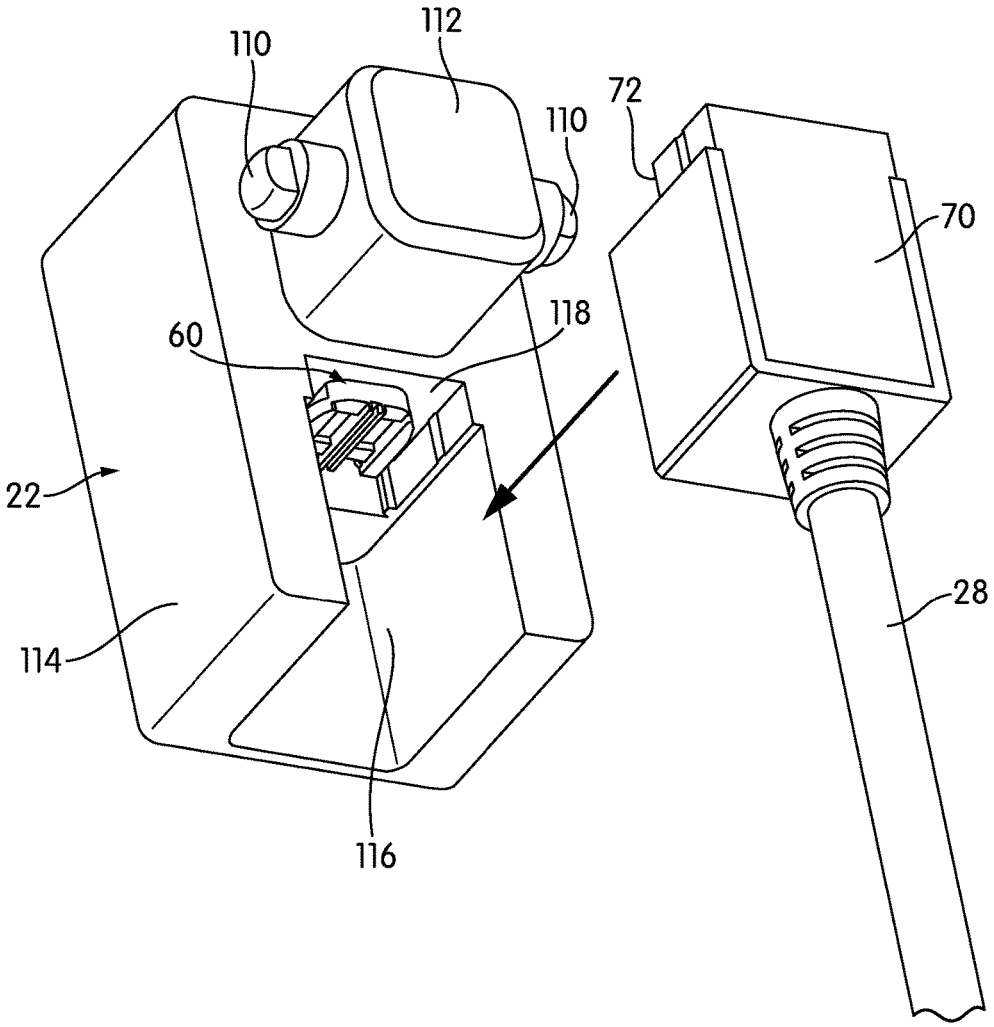
FIG. 10 is a perspective view of a plug adapted for use with the main power track of FIG. 1.

FIG. 10 is a perspective view of the plug 22 for the main power track 12 and the cable 28, illustrating their connection. The plug 22 itself has two relatively short, electrically conductive, spring-loaded prongs 110, one prong 110 extending from each side of a central protrusion 112 sized to fit within the main power track 12. Behind the central protrusion 112, the body 114 of the plug 22 is generally rectangular in overall shape, and includes an open cavity 116 sized for the connector 70 of the cable 28. Mounted on the sidewall 118 of the cavity 116 is male connecting structure 60. The connector 70 carries the complementary connecting structure 72.

Figure 11:
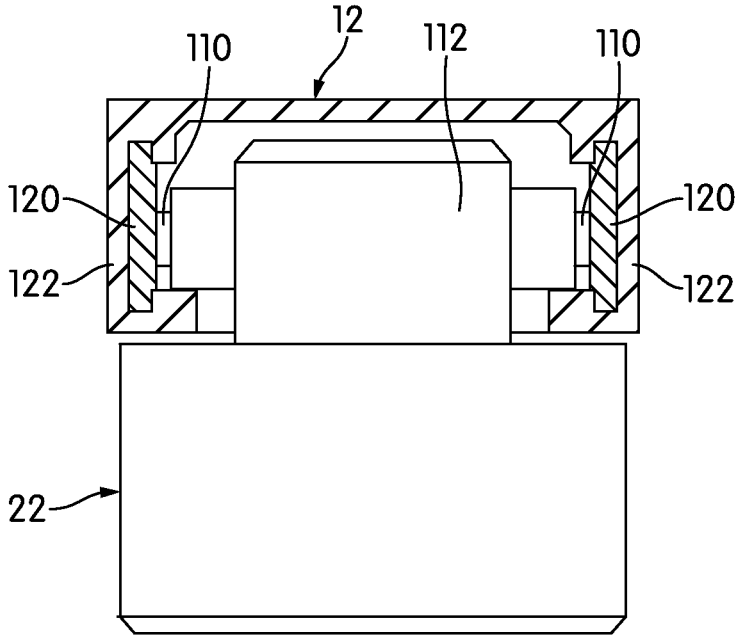
FIG. 11 is a cross-sectional view of the wall mount power track with the plug of FIG. 10 installed.

FIG. 11 is a cross-sectional view of the main power track 12 with the plug 22 installed. The main power track 12 itself is typically an extrusion, and may be made of either metal or plastic. Of course, if metal is used, it may be selectively passivated or insulated with nonconductive materials to avoid short circuit. As shown in FIG. 9, the extrusion of the main power track 12 is generally C-shaped, and carries conductors 120 for power and ground along opposite interior sidewalls 122. The prongs 110 from the plug 22 push out to the sides and contact the conductors 120. The power track will also typically terminate at one end with an insert, similar to the inserts 100, 108 described above, that allows it to connect to power. If a longer track is required, the main power track 12 may be connected to further power tracks in the same fashion as the light bars 18. At one end, the power track is connected, typically via an insert, to a transformer 124.

System 10 thus provides enough modularity and flexibility to provide power for and within shelving units 16 at multiple levels, supplying power to light bars 18 that can be directly connected together to provide light over arbitrary lengths. The same modular components and connectors 60, 72 are used to connect system elements together and to external power sources.

While the invention has been described with respect to certain embodiments, the description is intended to be exemplary, rather than limiting. Modifications and changes may be made within the scope of the invention, which is defined by the appended claims.

What is claimed is:

1. A power and lighting system for a shelving unit, comprising:

a first power track adapted to be disposed in an upright support of the shelving unit, the first power track including a central portion having adjacent, uninsulated first power and ground conductors running the length of the first power track, and first side portions connected continuously in a flexible, resilient manner to respective left and right sides of the central portion so as to extend generally perpendicularly therefrom over the entire length of the first power track, the side portions being adapted to deflect resiliently inwardly; and a first power plug including first and second contact prongs spaced vertically from one another, at least one of the first and second contact prongs being movable vertically relative to the other, and a coupling mechanism to couple the first power plug to an exterior surface of the upright support while the first and second contact prongs extend through openings in the upright support to contact the conductors within the first power track.

2. The power and lighting system of claim 1, further comprising one or more modular light bars, each light bar carrying light-emitting diode (LED) lighting elements.

3. The power and lighting system of claim 2, wherein each of the one or more modular light bars comprises an extrusion with the LED lighting elements disposed therein.

4. The power and lighting system of claim 3, wherein ends of each of the one or more modular light bars are terminated with inserts carrying first complementary male and female connectors, such that the one or more light bars can be directly and rigidly connected to one another without an intervening cable.

5. The power and lighting system of claim 4, further comprising a cable connecting between one of the one or more light bars and the first power plug.

6. The power and lighting system of claim 5, wherein the first power plug comprises a first complementary male connector or the first complementary female connector so as to connect to the cable.

7. The power and lighting system of claim 6, wherein the first power plug comprises a plurality of frangible portions spaced from one another along a body of the first power plug, such that the cable can exit the first power plug in a plurality of positions defined by the frangible portions.

8. The power and lighting system of claim 1, wherein the first power track is made of a plastic.

9. The power and lighting system of claim 1, wherein the coupling mechanism comprises a magnet.

10. The power and lighting system of claim 1, wherein the first and second contact prongs have contact tips on respective horizontal sides of the first and second contact prongs, the contact tips covering less than an entire surface area of the first and second contact prongs.

11. The power and lighting system of claim 1, further comprising:

a second power track; and a second power plug;

wherein the second power plug and the first power plug carry the same modular connecting structure.

12. The power and lighting system of claim 1, wherein the first power track is double-sided, such that the first power track further comprises:

adjacent, uninsulated second power and ground conductors provided on a second side of the central portion, such that the second power and ground conductors are opposite the first power and ground conductors, running the length of the first power track along the second side of the central portion; and second side portions connected continuously in a flexible, resilient manner to respective left and right sides of the central portion and extending outwardly therefrom, generally perpendicular to the second side of the central portion, the second side portions being positioned opposite the first side portions, extending over the entire length of the first power track, and being adapted to deflect resiliently inwardly.

13. The power and lighting system of claim 12, wherein the second power and ground conductors comprise strips or bars of a metal.

14. The power and lighting system of claim 12, wherein the second side portions are biased or shaped to extend slightly to the left and right sides of the central portion.

15. The power and lighting system of claim 1, wherein the first power and ground conductors comprise strips or bars of a metal.

16. The power and lighting system of claim 1, wherein the first side portions are biased or shaped to extend slightly to the left and right sides of the central portion.

17. The power and lighting system of claim 1, wherein the coupling mechanism comprises an adhesive pad or hook and loop fastener.

18. The power and lighting system of claim 1, further comprising one or more LED lighting elements electrically coupled to the first power plug.

19. A gondola shelving unit with a power and lighting system, comprising:

at least two upright supports, each upright support being hollow and including a series of openings therein;

one or more shelves, the shelves having bracket structure adapted to engage the uprights by engaging the openings;

a first power track disposed in one of the at least two upright support of the shelving unit, the first power track including a central portion having adjacent, uninsulated first power and ground conductors running the length of the first power track, and first side portions connected continuously in a flexible, resilient manner to respective left and right sides of the central portion so as to extend generally perpendicularly therefrom over the entire length of the first power track, the side portions being adapted to deflect resiliently inwardly; and a first power plug including first and second contact prongs spaced vertically from one another, at least one of the first and second contact prongs being movable vertically relative to the other, and a coupling mechanism to couple the first power plug to an exterior surface of the upright support while the first and second contact prongs extend through openings in the upright support to contact the conductors within the first power track.

20. The gondola shelving unit of claim 19, further comprising one or more LED lighting elements electrically coupled to the first power plug.

* * * * *